US011592274B2

(12) United States Patent
Heaton

(10) Patent No.: US 11,592,274 B2
(45) Date of Patent: Feb. 28, 2023

(54) DEVICE AND PROCESS FOR THE DESTRUCTION OF CHEMICAL WARFARE AGENTS

(71) Applicant: Dynasafe US LLC, Talladega, AL (US)

(72) Inventor: Harley Heaton, Blacksburg, VA (US)

( * ) Notice: Subject to any disclaimer, the term of this patent is extended or adjusted under 35 U.S.C. 154(b) by 1288 days.

(21) Appl. No.: 16/014,527

(22) Filed: Jun. 21, 2018

(65) Prior Publication Data

US 2019/0003812 A1 Jan. 3, 2019

Related U.S. Application Data

(60) Provisional application No. 62/525,804, filed on Jun. 28, 2017.

(51) Int. Cl.

| | |
|---|---|
| ***F42D 5/04*** | (2006.01) |
| ***F42D 5/045*** | (2006.01) |
| ***A62D 3/40*** | (2007.01) |
| ***F42B 33/06*** | (2006.01) |
| ***A62D 3/32*** | (2007.01) |
| *A62D 101/02* | (2007.01) |

(52) U.S. Cl.

CPC ..... *F42D 5/045* (2013.01); *A62D 3/32* (2013.01); *A62D 3/40* (2013.01); *F42B 33/067* (2013.01); *A62D 2101/02* (2013.01); *A62D 2203/10* (2013.01)

(58) Field of Classification Search

CPC .. F42D 5/04; F42D 5/045; A62D 3/32; A62D 3/40; A62D 2101/02; A62D 2203/10; F42B 33/067

USPC ..... 588/321

See application file for complete search history.

(56) References Cited

U.S. PATENT DOCUMENTS

| | | | |
|---|---|---|---|
| 5,062,372 | A | 11/1991 | Ritter |
| 5,108,718 | A | 4/1992 | Dummersdorf et al. |
| 5,582,119 | A | 12/1996 | Barkdoll |
| 5,584,071 | A | 12/1996 | Kalyon et al. |
| 5,819,673 | A | 10/1998 | Heywood et al. |
| 5,864,767 | A | 1/1999 | Drumgoole et al. |
| 5,881,654 | A | 3/1999 | Fleming et al. |
| 6,011,193 | A | 1/2000 | Myler et al. |
| 6,173,662 | B1 | 1/2001 | Donovan |
| 6,196,107 | B1 | 3/2001 | Hoffman et al. |
| 6,260,464 | B1 | 7/2001 | Gorrell et al. |
| 6,269,725 | B1 | 8/2001 | Cherry |
| 6,269,746 | B1 | 8/2001 | Larsen |
| 6,766,744 | B1 | 7/2004 | Song et al. |
| 6,881,383 | B1 | 4/2005 | Tschritter et al. |
| 6,938,533 | B2 | 9/2005 | Holland et al. |
| 7,005,991 | B1 | 2/2006 | Clers |
| 7,026,570 | B2 | 4/2006 | Remy |
| 7,073,424 | B2 | 7/2006 | Ferrari et al. |
| 7,501,551 | B2 | 3/2009 | Eidelman et al. |
| 7,700,047 | B2 | 4/2010 | Quimby et al. |
| 8,006,600 | B2 | 8/2011 | Fujiwara et al. |
| 8,387,503 | B2 | 3/2013 | Lesage et al. |
| 8,464,624 | B2 | 6/2013 | Asahina et al. |
| 8,468,945 | B2 | 6/2013 | Koide et al. |
| 8,516,937 | B2 | 8/2013 | Koide et al. |
| 8,573,108 | B2 | 11/2013 | Ohlson |
| 8,621,973 | B2 | 1/2014 | Abbe et al. |
| 8,887,609 | B1 | 11/2014 | Cherry |
| 9,027,453 | B2 | 5/2015 | Ueda et al. |
| 9,327,809 | B2 | 5/2016 | Shinkai et al. |
| 9,417,043 | B2 | 8/2016 | Ohlson |
| 9,470,499 | B2 | 10/2016 | Benson |
| 2012/0192704 | A1 | 8/2012 | Wilson et al. |
| 2016/0076865 | A1 | 3/2016 | Porté et al. |
| 2017/0010077 | A1 | 1/2017 | Medina et al. |

OTHER PUBLICATIONS

American Society of Mechanical Engineers, "Power Piping—ASME Code for Pressure Piping, B31 (ASME B31.1—2001)", 2001.

S. H. Fischer and M. C. Grubelich, "A Survey of Combustible Metals, Thermites, and Intermetallics for Pyrotechnic Applications", Sandia National Laboratories, Albuquerque, NM 87185-1453 and presented at the 32nd AIAA/ASME/SAE/ASEE Joint Propulsion Conference, Buena Vista, FL, Jul. 1-3, 1996.

*Primary Examiner* — Edward M Johnson

(74) *Attorney, Agent, or Firm* — New River Valley IP Law, P.C.; Michele L. Mayberry

(57) ABSTRACT

A device for destroying a chemical agent is described. The device includes a self-contained, portable pressure vessel which is dimensioned to accommodate an artillery shell, and a heat-generating component within the pressure vessel. The heat-generating component is capable of providing a pyrolytic, exothermic reaction capable of destroying the chemical agent and artillery shell. A process for destroying a chemical agent which includes placing a chemical artillery shell within the pressure vessel, securing the pressure vessel closed, and igniting the heat-generating component inside the pressure vessel to generate a pyrolytic, exothermic reaction capable of destroying the chemical agent and artillery shell is also described.

21 Claims, 2 Drawing Sheets

DEVICE AND PROCESS FOR THE DESTRUCTION OF CHEMICAL WARFARE AGENTS

CROSS-REFERENCE TO RELATED APPLICATIONS

The present application relies on the disclosure of and claims priority to and the benefit of the filing date of U.S. Provisional Application No. 62/525,804, filed Jun. 28, 2017, the disclosure of which is hereby incorporated by reference herein in its entirety.

BACKGROUND OF THE INVENTION

Field of the Invention

The present invention relates to destruction of chemical warfare agents. More particularly, embodiments of the present invention relate to a process and a device for the destruction of chemical warfare agents in munitions. Additionally, the device could be used to destroy smaller conventional munitions.

Description of Related Art

Soldiers in the field may find chemical weapons that must be secured or destroyed, but they lack the means to do so. Current devices or processes are large, cannot be carried or used by a dismounted soldier, or require an external energy source, such as utility support such as natural gas, propane or electricity to work. Examples of existing devices can be found in U.S. Pat. Nos. 9,327,809, 9,027,453, 8,468,945, 8,621,973, 8,887,609, 8,387,503, 7,501,551, 6,938,533, 7,073,424, 7,026,570, 6,269,746, 6,269,725, 5,881,654, 6,011,193, 5,108,718, 9,417,043, 9,470,499, 8,464,624, 8,516,937, 8,573,108, 8,006,600, 7,700,047, 6,766,744, 7,005,991, 6,881,383, 6,260,464, 6,173,662, 6,196,107, 5,864,767, 5,819,673, 5,582,119, 5,584,071, 5,062,372, and U.S. Published Application Nos. 2017/0010077, 2016/0076865, and 2012/0192704. There exists a need for a small, safe, lightweight and self-contained device for the destruction of chemical warfare agents and munitions.

SUMMARY OF THE INVENTION

To this end, embodiments of the invention provide a device for destroying a chemical agent in a container or munition, or a smaller conventional munition. The device includes a self-contained, portable pressure vessel which is dimensioned to accommodate an artillery shell, as well as a heat-generating component within the pressure vessel. In embodiments, the heat-generating component is capable of providing a pyrolytic, exothermic reaction capable of destroying the chemical agent and artillery shell.

According to one aspect, the heat-generating component is not or does not require a utility selected from natural gas, propane, and electricity or other external energy source.

According to another aspect, the heat-generating component includes a chemical composition, such as a chemical composition capable of decomposing, disintegrating, deteriorating, melting, reacting, and/or otherwise destroying or disarming munitions and chemical warfare agents when exposed to heat.

According to another aspect, the chemical composition includes a thermite, thermate, or intermetallic composition, or any combination of these. In embodiments, the chemical composition is capable of melting or otherwise destroying a munition without an explosion or otherwise blasting the munition. In embodiments, the chemical composition, such as a thermite, thermate, or intermetallic composition, or combinations thereof, is not explosive.

According to another aspect, the pressure vessel includes at least one insulation layer disposed between the heat-generating component and a wall of the pressure vessel.

According to another aspect, the insulation layer includes ceramic, ceramic fiber, fiberglass, mineral wool, polycrystalline fiber, vermiculite, or calcium silicate, or any combination of these, including similar materials.

According to other aspects, the heat-generating component includes a first fire mix, such as a combination of permanganate and glycerin, or magnesium ribbon.

According to another aspect, the device further includes an igniter capable of igniting the heat-generating component and can include a first fire mix as well.

According to another aspect, the pressure vessel includes a hollow body such as a hollow cylindrical body with at least one end cap and/or at least one flange joined at each end of the cylindrical body.

Embodiments of the invention also provide a device for destroying a chemical agent which includes a body comprising first and second sections, such as first and second hollow cylindrical sections, each cylindrical section having an end cap joined at one end and a flange joined at an opposing end. The flange of the first cylindrical section and the flange of the second cylindrical section are capable of being secured together when juxtaposed to form a pressure vessel. Further, the pressure vessel is dimensioned to accommodate an artillery shell and is capable of withstanding the generation of heat inside the pressure vessel from a pyrolytic, exothermic reaction capable of destroying the chemical agent and artillery shell, and any potential explosion of any explosives that may be contained within the artillery shell.

According to one aspect, the flange of the first cylindrical section and flange of the second cylindrical section are capable of being fastened together with bolts, clamps, interlocking lug, expanding or contracting ring, cam latch, bar locking swing bolt or similar type closures.

According to another aspect, the first cylindrical section and/or second cylindrical section is a pipe.

According to another aspect, the first and second cylindrical sections include a wall including steel, stainless steel, light weight titanium, fiber wound composite material, high-temperature aluminum alloys and/or nickel alloys, and/or carbon-carbon composites, or combinations of these. The wall of the pressure vessel (i.e., the walls of the cylindrical components or sections) is made of a material capable of withstanding pressure generated inside the vessel, for example, from any heat, gas, shock and/or vapor that may be generated when disabling the munition and/or decomposing the chemical agent in the vessel. That is, the pressure vessel is capable of containing contents therein even in light of any pressure or shock that may be generated inside the vessel from interaction of the heat-generating component with the munition, a fire mix, and/or a reaction initiator.

According to another aspect, the first and/or second cylindrical sections further include an insulation layer disposed adjacent to the wall.

According to another aspect, the insulation layer is further disposed in an interior of one or both cylindrical sections, and/or outside one or both cylindrical sections.

According to another aspect, the insulation layer includes ceramic, ceramic fiber, fiberglass, mineral wool, polycrystalline fiber, vermiculite, and/or calcium silicate, or any combination of these or similar materials.

According to another aspect, the insulation layer further includes one or more high temperature gaskets disposed between each end cap and cylindrical section.

According to another aspect, the device is self-contained and portable.

According to another aspect, each section of the device weighs no more than 100 pounds.

Embodiments of the invention also provide a device for destroying chemical warfare agents, which device includes a heat resistant, pipe type container with a closure, a thermite, thermate, and/or intermetallic heat-generating composition disposed inside the pipe type container, a first fire mix disposed inside the pipe type container, and an ignition device. The pipe type container can also include an insulating material to retain heat.

Embodiments of the invention also provide a process for destroying a chemical agent. The process includes placing a chemical artillery shell within the pressure vessel of any of the embodiments described herein, securing the pressure vessel closed, and igniting the heat-generating component inside the pressure vessel to generate a pyrolytic, exothermic reaction capable of destroying the chemical agent and artillery shell.

Embodiments of the invention also provide a process for destroying conventional explosives containing munitions that are within the explosive containment capability of the device.

According to aspects, the heat-generating component includes a chemical composition, such as a thermite, thermate, and/or intermetallic composition, or any combination of these.

According to another aspect, the process further includes porting the pressure vessel to a site having a chemical artillery shell.

According to another aspect of any of the above embodiments, the device is capable of being reused to destroy multiple chemical artillery shells.

According to another aspect of any of the above embodiments, the heat-generating component comprises consumable reagents capable of providing a pyrolytic, exothermic reaction which generates a quantity of heat sufficient to destroy the munition, and/or a quantity of heat just sufficient to destroy the munition and be completely consumed, and/or a quantity of heat sufficient to destroy multiple munitions simultaneously and/or sequentially.

According to another aspect of any of the above embodiments, the pressure vessel comprises heat-resistant materials which are not consumed or destroyed during activation of the heat-generating component.

These and other embodiments and their aspects will be further described in the foregoing Detailed Description.

BRIEF DESCRIPTION OF THE DRAWINGS

The accompanying drawings illustrate certain aspects of embodiments of the present invention and should not be used to limit the invention. Together with the written description the drawings serve to explain certain principles of the invention.

DETAILED DESCRIPTION OF VARIOUS EMBODIMENTS OF THE INVENTION

Figure 1:
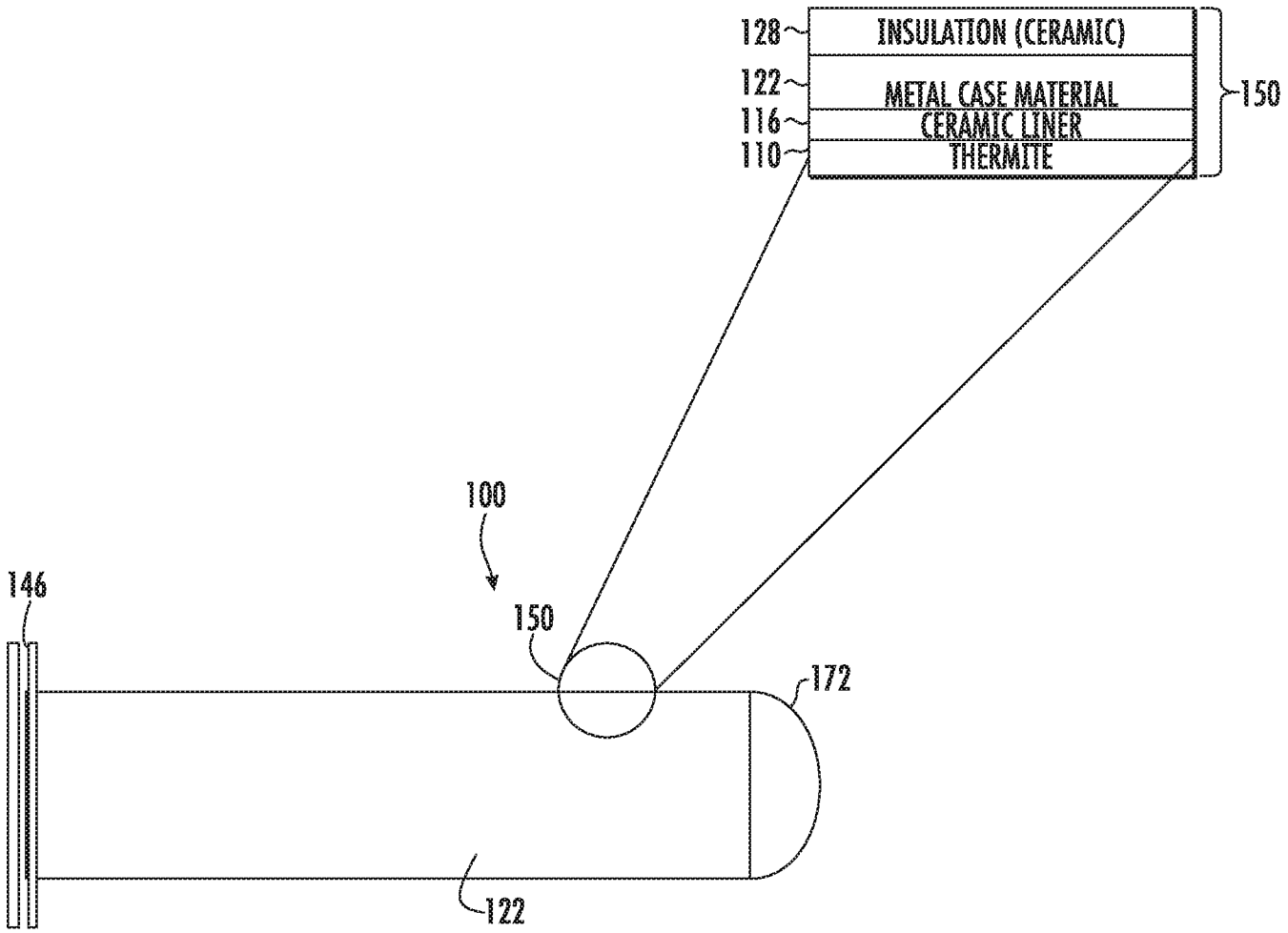
FIG. 1 is a diagram showing a chemical warfare agent destruction device according to an embodiment of the invention.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

As used herein, the term "about" is understood as within a range of normal tolerance in the art, for example within 2 standard deviations of the mean. The term "about" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

As previously stated, soldiers in the field may find chemical weapons that must be secured or destroyed, but they lack the means to do so. The invention claimed here solves this problem.

According to embodiments, the present invention allows an individual soldier to secure and destroy a chemical weapon in situ. Once the weapon is destroyed, the remnants can remain in place or can be removed to a different location safely. Upon destruction, the munition and/or chemical agent contained within are converted to less toxic byproducts.

The present invention differs from what currently exists. In embodiments, the present invention allows a soldier in the battlefield to be able to destroy and/or render a chemical warfare agent-containing munition unusable by an enemy, even in a combat situation where the munition may not be able to be recovered at that time for eventual disposal. Current devices are too large and heavy for use by individual soldiers, and setup time is too long to allow use in combat situations or high threat environments.

According to embodiments, the present invention is a small, portable lightweight device that is self-contained and does not require external utility support. The device can include 1) a pressure vessel and 2) consumable reagents within the pressure vessel capable of providing an exothermic reaction which generates a quantity of heat sufficient to destroy the munition. The pressure vessel itself includes heat-resistant materials and such is not consumed or destroyed when the device is activated. The device can be used and reused to destroy munitions in the field, and once activated the soldier does not need to remain in the area of the munition and can move on as the situation dictates without concern that the munition has been destroyed.

According to one embodiment, using the claimed device includes one or more of the following steps:

1. The individual soldier(s) carries the device to the battlefield. Optionally, the device can be carried by a vehicle of some sort.
2. The soldier opens the device and inserts the munition to be destroyed.
3. The soldier closes the device.
4. The soldier activates a chemical heating mantle.
5. Once activated, the soldier can leave the area.
6. The device destroys the munition, and/or renders it unfit for use by an adversary.

7. The destroyed munition and contents remain on the battlefield or at the location where left. Other soldiers can recover the device containing the destroyed munition contents if required after hostilities end.

Figure 2:
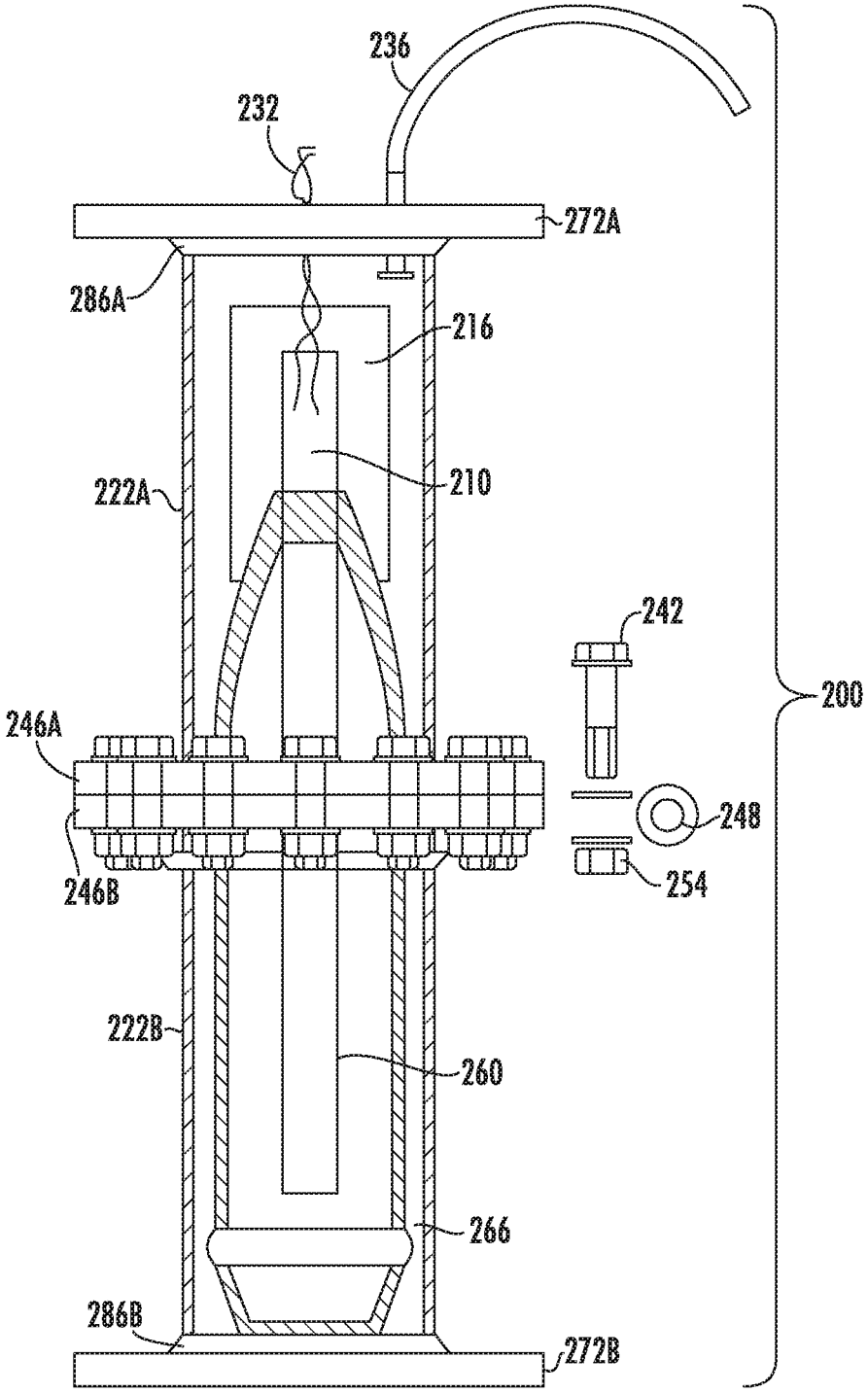
FIG. 2 is a diagram showing a chemical warfare agent destruction device according to another embodiment of the invention.

The following FIGS. 1 and 2 show exemplary components of the device. It is to be understood, however, that the device and its components can be any suitable size.

One embodiment of the device is shown in FIG. 1. According to this embodiment, vessel 100 includes a hollow cylindrical body such as a pipe section 122, which has weld cap 172 and flange 146 fixed to ends of pipe section 122. The pipe section is dimensioned to accommodate an artillery shell, and for example can have a length of 0.83 meters (whether including or excluding cap 172) and a width of 0.20 meters. Together, the pipe section, welded end cap 172 and welded flange 146 depicted in FIG. 1 with an appropriate high temperature gasket (not shown) provide a pressure vessel that is capable of retaining heat and gases emitted during destruction of an artillery shell contained within.

Further, FIG. 1 shows that the pipe section can additionally comprise multiple components 150. As shown in the expanded diagram at the top right of the figure, the pipe section 122 can include at least four additional components: an internal component, two inner layers, and an outer layer. More particularly, the embodiment shown in FIG. 1 shows (progressing from interior to exterior) thermite 110, a ceramic liner layer 116 adjacent to the thermite 110, a metal case material 122 adjacent to the ceramic layer 116, and an outer insulation layer 128 which can be or include ceramic or other high temperature insulator.

Not shown in FIG. 1, the interior thermite 110 can extend to the interior of the vessel to surround an artillery shell enclosed within. Further, while the expanded diagram shows each component in direct contact with each other, there can also be other components or a space between one or more or between each component.

The thermite 110 is the active component of the device 100 which when activated consumes and destroys the enclosed artillery shell by way of heat generated within the vessel. The ceramic liner 116 functions to limit heating of the metal case 122 when the device is activated, and the outer insulation 128 further prevents heat escape from device 100. The metal case material 122 with welded cap 172 and welded flange 146 functions to form the pressure vessel to retain the heat and pressure generated when the thermite is activated.

The device of FIG. 1 would be utilized by a soldier or other person by opening the device, inserting a munition or container to be treated, closing the device, and activating the igniter. Once activated, the device would carry out the destruction mission without further interaction by any person, and the device could be left in place or optionally transported to another location. The device could also optionally be retrieved later, and the contents re-treated or removed.

Turning now to FIG. 2, another embodiment of the device is shown in detail and as assembled for destroying a munition enclosed within. The device 200 includes two hollow cylindrical or tubular components that during use join to form a pressure vessel (such as steel) which can be metal pipe sections 222A and 222B, each having a flange 246A, 246B, which can be a neck flange capable of withstanding pressure. Each flange 246A, 246B can be welded to each pipe section 222A and 222B. Further, each pipe section 222A and 222B has end plate 272A, 272B welded at ends opposing the flanges 246A, 246B.

According to one embodiment, the metal pipe 222A and 222B is standard, steel pipe. According to one example, each steel pipe has a 7-inch nominal diameter, a 7.625-inch outer diameter, with 0.5-inch wall thickness. However, the steel pipe can be dimensioned to have larger or smaller diameters and/or wall thicknesses, to meet the requirements of a particular application. In other embodiments, the diameter of the hollow cylindrical components is 5, 5½, 6, 6½, 7, 7½, 8, 8½, 9, 9½, 10, 10½ inches or more, with a wall thickness of at least 0.25, 0.30, 0.30, 0.35, 0.40, 0.45, 0.50, 0.55, 0.60, 0.65, 0.70, 0.75, 0.80, 0.85, 0.90, 0.95, 1.0 inches or more. The pipe dimensions can be selected according to the size and type of the munition being destroyed.

According to the embodiment shown in FIG. 2, the metal pipe 222A and 222B are of equal length such that each section of the device (i.e. pipe 222A or 222B including welded flange 246A or 246B and end plate 272A or 272B) represents one half of the total height and weight of the device when assembled (each section represents about 50% of the total height of the assembled device). However, it should be understood that the present invention contemplates dimensional variations such that one section is longer than the other. For example, one section may represent 60% of the total height, while the other may contribute 40% of the total height of the assembled device. In other examples, the two sections represent 70%/30%, 75%/25%, 80%/20%, 85%/15%, 90%/10%, 95%/5% of the total height of the device. Even further, the device may comprise more than two sections in certain embodiments. The longer section(s) can be used as a "base" or bottom portion of the device, while the shorter section(s) can represent an intermediate part or "cap" or top portion of the device, or vice versa.

According to the embodiment shown in FIG. 2, the two sections are separate components that can be transported separately by a soldier in the field. However, other embodiments can include a hinge or similar mechanism by which the two sections are joined together so that the device can be opened and closed. The hinge allows for opening of the top portion of the device so that a munition can be inserted, as well as closing and then fastening the two portions together for when the device is to be activated.

According to one embodiment, the two sections are capable of being joined together when the flanges 246A and 246B are juxtaposed to provide a complete, assembled device. The sections can be secured together when the device 200 is assembled by any suitable fasteners, such as bolts 242, washers 248, and/or nuts 254 as shown, or by other closing mechanisms. According to one example, the device is assembled by twelve 3½ inch by ⅞ inch bolts, using a wrench or other suitable tools. Additionally, the present invention contemplates other mechanisms for securing assembly and closure of the device known in the art, as well as various locking mechanisms to ensure that enemy soldiers or other non-authorized persons cannot open the device. For example, in one embodiment, the flanges are configured so that they may be secured together with a combination lock, padlock, bolt, or any combination thereof.

The weld caps 272A, 272B at opposing ends of the assembled device 200 can be metal endplates as shown. The metal endplates can be square-shaped, circular, or any other rectilinear or curvilinear shape. The device 200 can also have high temperature gaskets 286A and 286B secured to the ends of each pipe 222A, 222B underneath each endplate 272A, 272B. The pipe sections with attached weld caps and weld type flanges of FIG. 2, along with the high temperature gaskets, when assembled together provide a gas tight enclosure or pressure vessel for the munition to be destroyed. The assembled device keeps gas from escaping during the treatment process as well as contains generated heat.

According to one example, the device shown in FIG. 2 is dimensioned to have a total height of about 36 inches, such that each "half" has a height of about 18 inches. Further, the endplates are dimensioned to have a width or diameter of about 14.3 inches, with the flanges also having a diameter of about 14.3 inches. As should be apparent, the device is sufficiently compact such that the device is portable in the field (i.e. can be directly carried by a soldier). Further, other dimensional variations which provide a compact, portable device are also contemplated, including a total height of 15-30, 31, 32, 33, 34, 35, 36, 37, 38, 39, 40, 41, or 42 inches or more and/or an overall width ranging from about 5 inches to 20 inches or more.

According to embodiments, the device 200 further includes heat-generating composition or compositions 210, such as thermite, thermite, and/or intermetallic compositions of which several types can be used. Also included is a first fire mix (not shown; several compositions may be used) with an ignition device (not shown, wires 232 connect low-temperature thermite charge 210 to ignition device). The device 200 also includes one or more layers of insulation surrounding the device to retain heat (not shown). Also depicted in FIG. 2 is the artillery shell 260 which contains the chemical warfare agent to be destroyed. While not a component of the device 200, the shell 260 is depicted to illustrate how the device operates during use. The munition 260 to be destroyed can contain an explosive burster or not, or can be fuzed or not. As illustrated, the thermite charge 210 is contained within a ceramic cup 216 that fits over the nose of the munition 260 and acts as a barrier to prevent destruction of device 200 itself during use. The thermite charge 210 can also be of a different shape, may or may not require placement in a cup and can be placed at the rear of the munition or on the sides as circumstances dictate.

While a 152 mm shell is depicted, the device can accommodate or be dimensioned to accommodate multiple munition sizes such as 105 mm, 100 mm, 115 mm, 120 mm, 122 mm, 125 mm, 130 mm and 155 mm shells. Non-limiting examples of chemical artillery shells that can be destroyed by the device include the M687, M110, M104, and M121 artillery shells. Further, due to the extremely high temperatures generated inside the device when activated, it is contemplated that any chemical agent used in chemical warfare will be partially or completely destroyed by the device, representative examples including sarin, nitrogen mustard, sulfur mustard, VX, and phosgene.

Also shown in FIG. 2, the device 200 can optionally be equipped to vent gases and other volatile products of combustion of the munition after the device is activated. This is shown by pipe or tubing 236 which is inserted into an opening in one of the end caps. The pipe or tubing 236 can vent the combustion products to an off-gas treatment system such as an afterburner, where such gases are further processed. Such ventilation can also serve to reduce pressures within the vessel that result from destruction of the munition, after the reaction is completed.

In one embodiment, the container walls and flanges with end cap are engineered to be able to withstand temperatures and pressures developed during the destruction process. The thermite, thermite, and/or intermetallic heat generating composition(s) and the first fire mix (if needed) with ignition device together make up the heating component of the device, which drives the destruction reaction. The destruction reaction is pyrolytic, which means that additional oxygen is not required. The chemical warfare agent and any explosive burster or fuze that may be attached to the munition will also be destroyed due to the heat generated in the interior of the device. In embodiments, the pyrolytic reaction destroys the munition with or without actual detonation of any associated explosives within the munition.

After the munition is destroyed, carbonaceous materials and various hydrocarbon remnants in the container as well as the metal scrap from the munition will remain, but the chemical warfare agents and associated explosives (if any) will be destroyed or otherwise rendered inoperable. The munition will be rendered unusable by an adversary. The insulation surrounding the device serves to retain the heat developed by the heat generating mixture which allows for more efficient destruction.

According to embodiments, the components of the pressure vessel of the device are fabricated from steel, stainless steel, light weight titanium, fiber wound composite material, related high temperature high strength metals or alloys such as high-temperature aluminum alloys and nickel alloys, or composites such as carbon-carbon composites in a conventional manner, or combinations of these. If the components are entirely steel, each half of the device would weigh approximately 90-100 pounds (including pipe section (24 pounds), flange (20 pounds), and endplate (45 pounds)). Thus, it is contemplated that more lightweight materials such as titanium or carbon composite or combinations of these would provide even more portability to the device.

Broadly speaking, thermites are a mixture of a metal oxide and a more active pure metal, which when ignited produce a strong exothermic reaction. Examples include powdered aluminum and iron oxide, magnesium and iron oxide, zirconium and iron oxide. Various other metal oxides can be included, such as $Fe_2O_3$, $Fe_3O_4$, CuO, $Cu_2O$, $SnO_2$, $TiO_2$, $MnO_2$, $Mn_2O_3$, $Cr_2O_3$, CoO, $SiO_2$, NiO, $V_2O_5$, $Ag_2O$, $MoO_3$, to name a few. Thermates are thermites modified with additives which lower ignition temperatures, such as oxidizers like barium nitrate, potassium chromate and/or potassium permanganate. Other components used in thermates include sulfur, hydrocarbon oils, zinc powder, and magnesium powder. Intermetallic reactions are reactions between two different metal compounds. The heat generating compositions of the invention can be or include any thermite, thermate, and/or intermetallic composition (or any combination thereof) known in the art to generate exothermic reactions capable of producing high temperatures. According to embodiments, the heat generating compositions are selected from the mixtures described or listed in "A Survey of Combustible Metals, Thermites, and Intermetallics for Pyrotechnic Applications" by S. H. Fischer and M. C. Grubelich, Sandia National Laboratories, Albuquerque, N. Mex. 87185-1453 and presented at the 32nd AIAA/ASME/SAE/ASEE Joint Propulsion Conference, Buena Vista, Fla., Jul. 1-3, 1996 ("Fischer and Grubelich, 1996"), incorporated herein by reference in its entirety, or among similar compositions.

According to embodiments, the thermite, thermate, or intermetallic compositions, when ignited, heat the munition to be destroyed to a temperature of between about 300° C. and 500° C., and the thermite, thermate, or intermetallic composition itself can reach a temperature of at least 1500° C., 2000° C., 2500° C., 3000° C., 3500° C., 4000° C., or higher. While these temperatures are higher than the melting point of steel, a ceramic barrier between the thermite and the walls of the pressure vessel, such as the ceramic liner 116 shown in FIG. 1 or the ceramic cup 216 shown in FIG. 2, prevent melting of the steel (or other metal), or degradation of a composite pressure vessel when the thermite charge is ignited. In embodiments the ceramic cup 216 can be in contact with the walls of the vessel or the cup can be spaced away from all walls or some portion of the wall of the container to allow for additional air space or a larger void 266 in one or both portions 222A and/or 222B of the container. As the reaction temperatures of various thermite and other pyrotechnic compositions are known (see Fischer and Grubelich, 1996), a skilled artisan can select a composition to meet the requirements of a particular application. According to embodiments, the quasi static pressure inside the vessel may reach at least 25, 50, 75, 100, 125, or 150 PSI or higher, as such the vessel is constructed and comprises material(s) sufficient to withstand such pressures. Additionally, if the explosives contained in the munition (if any) detonate, the vessel will withstand the resulting shock or impulsive loadings.

According to embodiments, the first fire mix (if needed) is selected from permanganate/glycerin or magnesium ribbon or similar mixes known to the art.

According to embodiments, the ignition device is selected from several types of igniters known in the art such as pyrotechnic, hot surface, and spark (or electrode) igniters. Other igniters known to ignite thermite and similar compositions include hot-wire, exploding bridgewire (EBW) or semiconductor bridge (SCB) igniters, while other ignition methods include laser impingement, mechanical methods, or shock initiation (see Fischer and Grubelich, 1996). According to embodiments, the ignition device is capable of being activated by a human or robot by way of wired or wireless (e.g. radio, magnetic) technology. According to other embodiments, the ignition device allows the device to be activated by way of a timer.

According to embodiments, the insulation is selected from any high temperature type insulation such as ceramic, ceramic fiber, fiberglass, mineral wool, polycrystalline fiber, vermiculite, calcium silicate, and the like. The insulation can be disposed to line the interior of the pressure vessel, surround the exterior of the pressure vessel, or both.

According to embodiments, the high temperature gasket can be made of or include materials capable of withstanding extreme temperatures such as graphite, ceramic, metal or fiberglass in various compositions such as laminates, foils, or weaves or blends with other materials. According to embodiments, the high temperature gasket material can withstand temperatures over 1000° F. A non-limiting example of a high temperature gasket material that can be used in the device is FIBERFRAX®, a ceramic fiber material that can withstand temperatures from 1300° F. to 2300° F., depending on the grade of material (Custom Gasket Manufacturing, Englewood Cliffs, N.J.).

According to embodiments, the destruction device includes any one or more of the heat-generating mixtures, the first fire mixes, the ignition device, and the insulation described herein. It is to be understood that there are several types of thermite, thermite, and/or intermetallic heat-generating composition(s) and several first fire compositions and ignition devices available to a skilled artisan. Any suitable composition or device can be selected based on the anticipated mission requirements.

In alternative embodiments, the device can include handles, homing beacons, or warning placards for civilian populations warning them to not open the device after the device has been activated.

The following describes an example of how the device of FIG. 2 is used. In one embodiment, a person using the invention would typically be a soldier, but could be any person. A minimum amount of training is required. The person would simply bring the device to the munition. Alternatively, the munition could be brought to the device or both could be brought to a common location. Next, the munition is placed inside the device and the device is closed by way of joining and bolting (or using other suitable fasteners or closure systems) the neck flanges of each section together. The device is then activated by way of the ignition device. Once activated, the device destroys the munition and munition contents without further attendance or requirements by the person using the device. Advantageously, the device does not require an external energy source, such as utility support or usage such as natural gas, propane or electricity to work. Further, when the device is recovered after destroying the munition, the device can be opened in a safe location and the remnants of the munition can be cleared from the device. The device can then be reused to destroy another chemical munition.

In an alternative embodiment, the device can be used and activated by a robot. In another alternative embodiment, the device can also be used to destroy smaller conventional munitions, and the device can be used to decontaminate chemical agent-contaminated items or soils, provided they physically fit within the device. In another alternative embodiment, the device includes a radio or other wireless locator beacon that can allow a soldier to track location of the device when returning to the battlefield, and/or can transmit GPS coordinates of the device's location. In yet another alternative embodiment, the device is configured to have one or more wheels, or is adapted to fit inside a wheelbarrow, cart, trolley, etc. (either general purpose or specifically designed to carry the device), to facilitate transport of the device in the field.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A device for destroying a chemical agent, comprising:

a self-contained, portable pressure vessel which is dimensioned to accommodate an artillery shell; and a heat-generating component within the pressure vessel;

wherein the heat-generating component is capable of providing a pyrolytic, exothermic reaction capable of destroying the artillery shell and any chemical agent therewith.

2. The device of claim 1, wherein the heat-generating component is not or does not require an external energy source.

3. The device of claim 1, wherein the heat-generating component comprises a chemical composition.

4. The device of claim 3, wherein the chemical composition comprises a thermite, thermate, or intermetallic composition, or any combination of these.

5. The device of claim 1, wherein the pressure vessel comprises at least one insulation layer disposed between the heat-generating component and a wall of the pressure vessel.

6. The device of claim 5, wherein the insulation layer comprises ceramic, ceramic fiber, fiberglass, mineral wool, polycrystalline fiber, vermiculite, or calcium silicate, or any combination of these.

7. The device of claim 1, wherein the heat-generating component contains a first fire mix.

8. The device of claim 7, wherein the first fire mix comprises a combination of permanganate and glycerin, or magnesium ribbon.

9. The device of claim 1, wherein the device further comprises an igniter capable of igniting the heat-generating component.

10. The device of claim 1, wherein the pressure vessel comprises a hollow cylindrical body with at least one end cap and/or at least one flange.

11. A device for destroying a chemical agent, comprising:

a first and second hollow cylindrical section, each cylindrical section having a closed end and a flange at an opposing end;

wherein the flange of the first cylindrical section and the flange of the second cylindrical section are capable of being secured together when juxtaposed to form a pressure vessel;

wherein the pressure vessel is dimensioned to accommodate an artillery shell and is capable of withstanding generation of heat inside the pressure vessel from a pyrolytic, exothermic reaction capable of destroying the artillery shell and any chemical agent therewith.

12. The device of claim 11, wherein the flange of the first cylindrical section and flange of the second cylindrical section are capable of being fastened together with bolts or other closure devices.

13. The device of claim 11, wherein the first cylindrical section and/or second cylindrical section is a pipe.

14. The device of claim 11, wherein the first and second cylindrical sections comprise a wall comprising steel, stainless steel, light weight titanium, fiber wound composite material, high-temperature aluminum alloys or nickel alloys, or carbon-carbon composites or combinations of these.

15. The device of claim 14, wherein the first and second cylindrical sections further comprise an insulation layer disposed adjacent to the wall.

16. The device of claim 15, wherein the insulation layer is further disposed in an interior of one or both cylindrical sections, or outside one or both cylindrical sections, or both.

17. The device of claim 15, wherein the insulation layer comprises ceramic, ceramic fiber, fiberglass, mineral wool, polycrystalline fiber, vermiculite, or calcium silicate, or any combination of these or similar materials.

18. The device of claim 11, wherein the closed end of each cylindrical section comprises an end cap and one or more high temperature gaskets disposed between each end cap and cylindrical section.

19. The device of claim 11, wherein the device is self-contained and portable.

20. The device of claim 11, wherein each section of the device weighs no more than 100 pounds.

21. A device for destroying chemical warfare agents comprising:

a heat resistant, pipe container with a closure;

a thermite, thermate, and/or intermetallic heat-generating composition disposed inside the pipe container;

a first fire mix disposed inside the pipe container; and an ignition device;

wherein the pipe container comprises an insulating material to retain heat.

* * * * *